US007563052B2

(12) United States Patent
Van Reijen

(10) Patent No.: US 7,563,052 B2
(45) Date of Patent: Jul. 21, 2009

(54) SPORTS FLOOR AND METHOD FOR CONSTRUCTING SUCH A SPORTS FLOOR

(75) Inventor: Peter Van Reijen, LZ Uden (NL)

(73) Assignee: Tapijtfabriek H. Desseaux N.V., Oss (NL)

( * ) Notice: Subject to any disclaimer, the term of this patent is extended or adjusted under 35 U.S.C. 154(b) by 106 days.

(21) Appl. No.: 10/554,735

(22) PCT Filed: Apr. 29, 2004

(86) PCT No.: PCT/NL2004/000289

§ 371 (c)(1),
(2), (4) Date: Mar. 9, 2007

(87) PCT Pub. No.: WO2004/097117

PCT Pub. Date: Nov. 11, 2004

(65) Prior Publication Data

US 2008/0015038 A1 Jan. 17, 2008

(30) Foreign Application Priority Data

Apr. 29, 2003 (NL) ..... 1023301

(51) Int. Cl.
*E01C 3/04* (2006.01)

(52) U.S. Cl. ..... 404/28; 404/31; 404/75

(58) Field of Classification Search ..... 404/31, 404/34, 35, 28, 75
See application file for complete search history.

(56) References Cited

U.S. PATENT DOCUMENTS

| | | | | |
|---|---|---|---|---|
| 1,765,652 | A * | 6/1930 | Burgess | 404/21 |
| 3,960,375 | A * | 6/1976 | Bibi-Roubi et al. | 472/92 |
| 4,572,705 | A | 2/1986 | Vignon et al. | |
| 4,797,026 | A * | 1/1989 | Webster | 404/28 |
| 4,965,097 | A * | 10/1990 | Bach | 428/194 |
| 5,123,778 | A * | 6/1992 | Bohnhoff | 404/28 |
| 5,147,150 | A | 9/1992 | Berkhout et al. | |
| 5,287,649 | A * | 2/1994 | Prestele | 47/33 |
| 5,496,610 | A * | 3/1996 | Landi et al. | 428/73 |
| D423,123 | S * | 4/2000 | Sassenberg | D25/152 |
| 7,108,454 | B2 * | 9/2006 | Blackwood | 405/36 |
| 7,204,065 | B2 * | 4/2007 | Naji | 52/741.1 |
| 7,210,876 | B2 * | 5/2007 | Moralez et al. | 404/36 |
| 7,290,958 | B2 * | 11/2007 | Blackwood | 405/50 |
| 7,341,401 | B2 * | 3/2008 | Blackwood | 405/36 |

FOREIGN PATENT DOCUMENTS

| | | |
|---|---|---|
| DE | 1 884 331 | 12/1963 |

(Continued)

*Primary Examiner*—Gary S Hartmann
(74) *Attorney, Agent, or Firm*—Oblon, Spivak, McClelland, Maier & Neustadt, P.C.

(57) ABSTRACT

A sports floor, comprises a substrate disposed on an underlying honeycomb structure placed on a support base. The honeycomb structure comprises a series of substantially identical cells arranged in rows. The cells include lateral cell walls adjoining each other according to an annular configuration, forming cell openings upon extension of the honeycomb structure. A mesh width of the cell openings ranges between 20 and 100 mm, a height of the cell walls ranges between 5 and 250 mm, and a ratio of the mesh width to the height of the cell walls ranges between 1:4 and 1:0.1.

23 Claims, 1 Drawing Sheet

FOREIGN PATENT DOCUMENTS

| | | |
|---|---|---|
| EP | 0 005 238 | 11/1979 |
| FR | 2 659 996 | 9/1991 |
| FR | 2 691 726 | 12/1993 |
| FR | 2 718 768 | 10/1995 |
| FR | 2 729 874 | 8/1996 |

* cited by examiner

SPORTS FLOOR AND METHOD FOR CONSTRUCTING SUCH A SPORTS FLOOR

BACKGROUND OF THE INVENTION

I. Field of the Invention

The present invention relates to a sports floor, or a part thereof, comprising a substrate disposed on an underlying honeycomb structure, which honeycomb structure is placed on a support base. The present invention furthermore relates to a method for constructing such a sports floor.

II. Description of Related Art

Such a sports floor and a method for constructing such a sports floor are known per se from International application PCT/NL01/00669 filed previously in the name of the present applicant. According to the method that is known therefrom, the construction of an artificial grass fields is started with the removal of earth from a piece of land to a depth of about 18 centimeters. Subsequently, gravel is deposited on the bottom of the stripped part, followed by the drainage layer. The removed earth is screened and subsequently deposited on the drainage layer as a base course. Following that, only synthetic fibres are inserted into the base course, with at least one end of each of said synthetic fibres extending above the final surface level. From European patent application No. 0 554 330, which was previously filed in the name of the present applicant, there is furthermore known a method for constructing a field of artificial grass, wherein the stripped piece of land is successively filled with a 35-20 cm thick sand bed and a 15-30 cm thick layer of nutrient medium, preferably consisting of humous sand. After the ground structure has thus been prepared, artificial grass fibres are mechanically inserted into the ground and the upper course is seeded with natural grass, so that a combination of natural grass and artificial grass is obtained.

French patent application No. 2 659 996 relates to a substructure for a sports field wherein use is made of a rigid honeycomb structure, which is provided with a water-permeable geotextile at the upper side thereof. Present at the bottom side of the rigid honeycomb structure is a water-impermeable layer. The rigid honeycomb structure being used therein is not provided with any filling material but functions to store water therein, for example, so that the roots can draw their water therefrom in times of drought.

European patent application No. 0 005 238 relates to a foundation for a sports field wherein use is made of a rigid honeycomb structure, the hollow spaces of which are filled with a filling material. Furthermore, a water-impermeable intermediate layer is present on the rigid honeycomb structure.

From U.S. Pat. No. 4,497,853 there is known an artificial turf wherein a tufted carpet comprising a primary backing layer lies upon a secondary backing layer. Said secondary backing layer is disposed on a water-impermeable layer overlying a support base. The special use of a honeycomb structure is not known therefrom.

U.S. Pat. No. 6,221,445 relates to a base surface for an artificial sports turf wherein grid cells interconnected by means of a special connecting construction are used.

From U.S. Pat. No. 5,406,745 there is known a rigid honeycomb structure, in which grass can be grown to obtain a stable surface for vehicles to drive on.

BRIEF SUMMARY OF THE INVETION

The object of the present invention is to provide a sports floor, or a part thereof, which requires a minimum amount of maintenance, which exhibits a good compatibility with the support base and which is moreover remarkable for an excellent drainage.

Another aspect, of the present invention concerns the provision of a sports floor, or a part thereof, which sports floor is constructed in such a manner that frost-related problems are minimised.

Another aspect of the present invention concerns the provision of a sports floor, or a part thereof, which sports floor exhibits good shock-absorbing characteristics, so that the risk of sporters sustaining injuries on the sports floor is minimised.

Another aspect of the present invention concerns the provision of a method for constructing a sports floor, which method can be carried out in a relatively short space of time and which results in a sports floor having a substantially flat upper course.

Yet another aspect of the invention concerns the provision of a method for constructing a sports floor, which method employs a minimum volume of construction materials, thus enabling low-volume transport of the final sports floor.

Yet another aspect of the invention concerns the provision of a method for constructing a sports floor, which sports floor, because of the small volume of the construction means, can be transported at low cost, thus increasing the geographic applicability of the sports floor.

The sports floor as referred to in the introduction is characterized in that the honeycomb structure has a harmonica-like configuration consisting of a series of substantially identical cells arranged in rows, which cells have lateral cell walls adjoining each other according to an annular configuration, forming cell openings upon extension of the harmonica-like configuration.

One or more of the above objects are accomplished by using such a sports floor, or a part thereof, in particular the use of a harmonica-like honeycomb structure makes it possible to realise the construction of the present sports floor in a simple manner and at low transport costs. The honeycomb structure that is used in the present invention consists of a series of substantially identical cells arranged in rows, which cells have lateral cell walls adjoining each other according to an annular configuration so as to form cell openings, said cell openings adjoining the substrate at their upper side and the support base at their bottom side. In fact, a three-layer construction consisting of, successively, the substrate, the honeycomb structure and the supporting base is obtained in this way. In a specific embodiment the substrate may be integral with the honeycomb structure.

The present inventors have discovered that the stability of the present harmonica-like honeycomb structure is partially determined by the height, with the ratio between the horizontal force and the vertical force, for example for sand as the filling material, being at least about 1:3. A cell opening having a radius of about 15 mm thus requires a height of at least 45 mm. A very stable honeycomb structure is obtained when using a height in the 50-60 mm range. In a specific construction, however, cell openings having a radius of e.g. 20 mm are required, resulting in a height in the 60-70 mm range. Other suitable dimensions of the cell openings are: a radius of about 25 mm and a height in the 80-90 mm range, a radius of about 30 mm and a height in the 90-100 mm range.

To obtain a very stable construction it is desirable to use a mesh width for the cell openings that ranges between 20 and 100 mm, in particular between 30 and 80 mm, more in particular between 40 and 70 mm. Since the preferred filling material has a grain size in the 1-4 mm range, it is desirable, in order to obtain a good consolidation and good drainage characteristics, for the cell opening to have a dimension of at least 5 times the upper limit of the filling material, i.e. at least 20 mm.

In a specific embodiment it is moreover desirable, for reasons of strength, stability, shock absorption and durability, to use a cell wall height in the 5-250 mm range, in particular in the 25-100 mm range, more in particular 40-70 mm.

The honeycomb structure used in the present sports floor is preferably configurated such that the mesh width/height ratio of the cells ranges between 1:4 and 1:0.1, preferably between 1:3 and 1:1.5.

To obtain good stability, shock absorption and rain-water drainage characteristics, it is in particular desirable for the cell openings to be filled with a filling material, which filling material is selected from the group consisting of minerals, natural and synthetic particles, or a combination thereof. Examples of such materials are: sand, lava, gravel and rubber particles, or a combination thereof. A very good result as regards shock absorption is obtained with a mixture of sand and rubber, a mixture of sand and cork and a mixture of sand, rubber and cork, which mixtures may furthermore contain chippings.

To prevent movement of the substrate with respect to. the honeycomb structure, it is desirable to provide the substrate with means for preventing such movement, viz. on the side of the substrate adjacent to the honeycomb structure. Examples of such means are studs, ribs or projections.

In a special embodiment, an intermediate layer may be present between the substrate and the honeycomb structure.

Such an intermediate layer is in particular intended to prevent horizontal movement of the upper course, in particular the substrate, with respect to the honeycomb structure and the support base, and in a specific embodiment it is desirable for the intermediate layer to be provided with means for preventing movement of the substrate with respect to the honeycomb structure, which means are present on the side of the intermediate layer adjacent to the honeycomb structure.

On the other hand, the intermediate layer may also be provided with means for preventing movement of the substrate with respect to the honeycomb structure on the side of the intermediate layer adjacent to the substrate, in which case it may be advantageous for the intermediate layer to be provided with means for preventing movement of the substrate with respect to the honeycomb structure and with respect to the support base both on the side of the intermediate layer adjacent to the honeycomb structure and on the side of the intermediate layer adjacent to the support base.

To prevent the filling material present in the cell openings from flowing out of the honeycomb structure at the bottom side of the cell openings, an additional layer may be present between the honeycomb structure and the support base.

In order to effect adequate drainage, the support base is preferably provided with water drainage means.

A suitable substrate is, for example, a substrate comprising artificial grass fibres, which artificial grass fibres extend substantially transversely to the substrate. In a specific embodiment, it is furthermore preferable for the substrate to comprise a combination of natural fibres and synthetic fibres.

The present invention furthermore comprises a method for constructing a sports floor, or a part thereof, comprising the steps of:

(a) removing the earth from a piece of land to a first level below the final surface level, (b) laying a draining system on or in the bottom of said stripped piece of land, if necessary, (c) filling the stripped piece of land with a base course, characterized in that the method furthermore comprises the steps (d)-(f), viz.

(d) overlaying the support base with a harmonica-like honeycomb structure consisting of a series of substantially identical cells arranged in rows, which cells have lateral cell walls adjoining each other according to an annular configuration, (e) extending the honeycomb structure in such a manner that cell openings are formed, and (f) placing a substrate on the extended honeycomb structure as obtained in step (e), which substrate extends to said surface level.

With such a method it is in particular desirable to provide the honeycomb structure, which consists of a series of substantially identical cells arranged in rows, which cells have lateral cell walls adjoining each other according to an annular configuration so as to form the cell openings, with a filling material following step (e), which filling material is filled into the cell openings.

Preferably, the final sports floor, or a part thereof, extends to the original surface level. The first level according to step (a) corresponds to a level that may be considered to be stable or frost-free. Step (c) may be carried out by using the originally removed material, but it is also possible to use another stable material, such as sand and crushed stones.

The present invention also relates to the use of the sports floor as described above for practising sports, in particular ball sports and/or athletics.

In addition to that it is desirable in a specific embodiment to carry out an additional step (g) prior to step (f), said step (g) comprising (g) overlaying the honeycomb structure as obtained in step (e) with an intermediate layer, which intermediate layer may be considered as a sealing layer for the cell openings of the honeycomb structure.

BRIEF DESCRIPTION OF DRAWINGS

The present invention will be explained in more detail hereinafter with reference to the figures, in which.

DETAILED DESCRIPTION OF THE INVENTION

Figure 1:
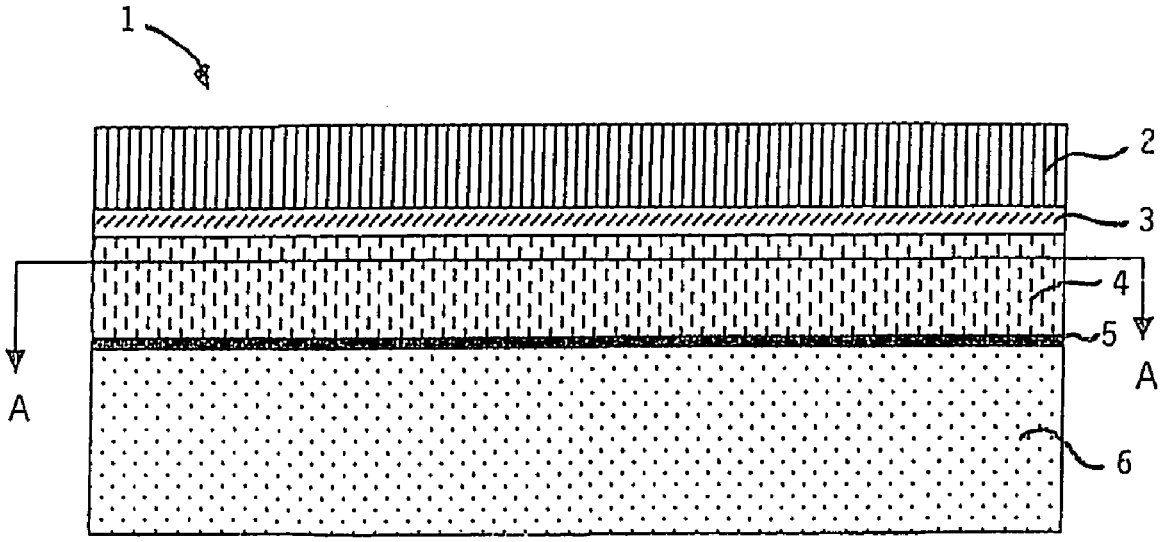
FIG. 1 is a schematic side elevation of a special embodiment of the present sports floor and FIG. 2 is a top plan view of the honeycomb structure as used in FIG. 1.

FIG. 1 shows a schematic side elevation of a special embodiment of the present sports floor 1, which sports floor 1 is suitable for practising a ball sport thereon, for example soccer or hockey. Earth is removed from a piece of land to a particular level below the final surface level, which level is in fact determined by the frost penetration depth. If desired, drainpipes may be provided. Following that, the support base 6 is filled up with a stable material, for example sand, crushed stones or the like, and in a specific embodiment earth from the previously stripped piece of land may be used. Subsequently, a honeycomb structure 4 is placed on the support base 6, which honeycomb structure 4 consists of a series of substantially identical cells arranged in rows, which cells have lateral cell walls adjoining each other according to an annular configuration so as to form cell openings 8. To obtain a stable construction, the cell openings 8 are filled with a filling material 7, for example sand. Following that, a substrate 2 is placed on the honeycomb structure 4, which substrate 2 is a substrate provided with synthetic fibres in the embodiment that is shown in FIG. 1, which synthetic fibres extend substantially transversely to the substrate 2. To prevent movement of the substrate 2 with respect to the honeycomb structure 4 and the support base 6, it is desirable in a specific embodiment to provide an intermediate layer 3, which intermediate layer 3 may be provided with means for preventing movement of the substrate 2 with respect to the honeycomb structure 4 and with respect to the support base 6, which means are present both on the side of the intermediate layer adjacent to the honeycomb structure 4 and on the side of the intermediate layer adjacent to the support base 6. In a specific embodiment it is also possible, on the other hand, to provide the substrate 2 at the lower side thereof with a studded structure, for example, which studded structure makes contact with the honeycomb structure 4, thus preventing movement of the substrate 2 with respect to the honeycomb structure 4 so that intermediate layer 3 may be omitted. In a specific embodiment it is furthermore desirable to provide an additional layer 5 between the honeycomb structure 4 and the support base 6.

Figure 2:
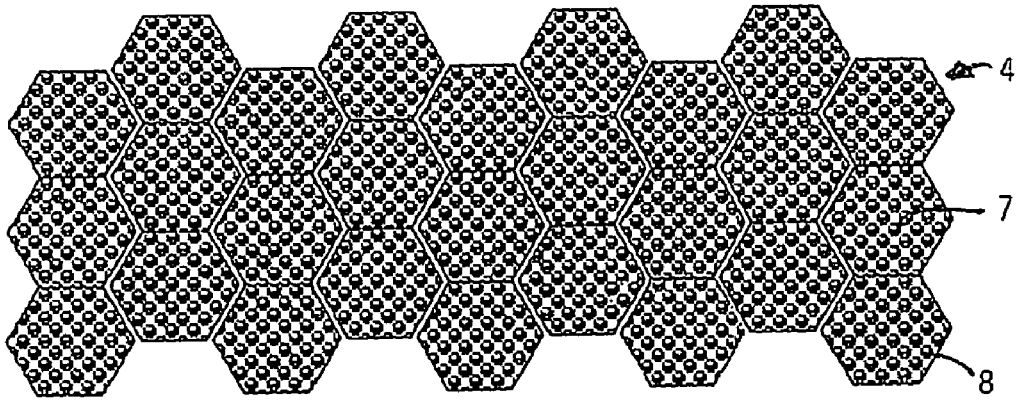

FIG. 2 is a top plan view of the honeycomb structure 4 that is shown in FIG. 1, which honeycomb structure 4 consists of a series of substantially identical cells arranged in rows, which cells are provided with cell openings 8, in which cell openings 8 a filling material 7 is present.

Although the special embodiment that is shown in FIG. 1 relates to a substrate 2 of artificial grass fibres, it should be understood that the present invention is not limited to such an embodiment. Thus it is possible to overlay the honeycomb structure 4 with a substrate 2 of such design that the sports floor, or a part thereof, that is obtained in this manner is suitable for practising athletics, for example. In a specific embodiment, on the other hand, the substrate as described herein, which is based on a honeycomb structure, may also be suitable for other uses not related to the practising of sports.

The invention claimed is:

1. A sports floor, comprising:

a substrate disposed on an underlying honeycomb structure placed on a support base, wherein the honeycomb structure comprises a series of substantially identical cells arranged in rows, the cells including lateral cell walls adjoining each other according to an annular configuration, forming cell openings upon extension of the honeycomb structure, a mesh width of the cell openings ranges between 20 and 100 mm, a height of the cell walls ranges between 5 and 250 mm, and a ratio of the mesh width to the height of the cell walls ranges between 1:4 and 1:0.1.

2. A sports floor according to claim 1, wherein said cell openings adjoin the substrate at an upper side of the cell openings and adjoin the support base at a bottom side of the cell openings.

3. A sports floor according to claim 1, wherein the mesh width of the cell openings ranges between 30 and 80 mm.

4. A sports floor according to claim 1, wherein the mesh width of the cell openings ranges between 40 and 70 mm.

5. A sports floor according to claim 1, wherein the cell wall height ranges between 25 and 100 mm.

6. A sports floor according to claim 1, wherein the cell wall height ranges between 40 and 70 mm.

7. A sports floor according to claim 1, wherein the ratio of the mesh width to the height of the cell walls ranges between 1:3 and 1:1.5.

8. A sports floor according to claim 1, wherein the cell openings are filled with a filling material.

9. A sports floor according to claim 8, wherein said filling material is selected from a group consisting of minerals, natural and synthetic particles, or a combination thereof.

10. A sports floor according to claim 9, wherein said filling material consists of a mixture of sand and rubber and/or cork.

11. A sports floor according to claim 1, wherein the substrate includes means for preventing movement of the substrate with respect to the honeycomb structure, and the means for preventing movement are present on a side of the substrate adjacent to the honeycomb structure.

12. A sports floor according to claim 1, further comprising: an intermediate layer between the substrate and the honeycomb structure.

13. A sports floor according to claim 12, wherein the intermediate layer is provided with means for preventing movement of the substrate with respect to the honeycomb structure, and the means for preventing movement are present on a side of the intermediate layer adjacent to the honeycomb structure.

14. A sports floor according to claim 12, wherein the intermediate layer is provided with means for preventing movement of the substrate with respect to the honeycomb structure, and the means for preventing movement are present on a side of the intermediate layer adjacent to the substrate.

15. A sports floor according to claim 12, wherein the intermediate layer is provided with means for preventing movement of the substrate with respect to the honeycomb structure, and the means for preventing movement are present both on a side of the intermediate layer adjacent to the honeycomb structure and on a side of the intermediate layer adjacent to the support base.

16. A sports floor according to claim 1, further comprising: an additional layer between the honeycomb structure and the support base.

17. A sports floor according to claim 1, wherein the support base is provided with water drainage means.

18. A sports floor according to claim 1, wherein the substrate comprises artificial grass fibers that extend substantially transversely to the substrate.

19. A sports floor according to claim 1, wherein the sports floor is configured to be used for practising sports and/or athletics.

20. A method for constructing a sports floor, comprising:

(a) removing earth from a piece of land to a first level below a final surface level to produce a stripped piece of land, (b) laying a draining system on the first level of the stripped piece of land, (c) filling the stripped piece of land with a base course, (d) overlaying the base course with a honeycomb structure consisting of a series of substantially identical cells arranged in rows, the cells including lateral cell walls adjoining each other according to an annular configuration and height of the cell walls ranges between 5 and 250 mm, (e) extending the honeycomb structure in such a manner that cell openings are formed such that a mesh width of the cell openings ranges between 20 and 100 mm and a ratio of the mesh width to the height of the cell walls ranges between 1:4 and 1:0.1, and (f) placing a substrate on the extended honeycomb structure as obtained in step (e) such that the substrate extends to the final surface level.

21. A method according to claim 20, wherein the honeycomb structure is provided with a filling material after step (e) has been carried out, and the filling material is filled into the cell openings.

22. A method according to claim 21, wherein the filling material is selected from a group consisting of minerals, natural and synthetic particles, or a combination thereof.

23. A method according to claim 20, wherein an additional step (g) is carried out prior to step (f), said step (g) comprising:

(g) overlaying the extended honeycomb structure as obtained in step (e) with an intermediate layer.

* * * * *